US010396514B2

(12) United States Patent
Smith et al.

(10) Patent No.: US 10,396,514 B2
(45) Date of Patent: Aug. 27, 2019

(54) POWER DISTRIBUTION UNIT RETENTION DEVICE

(71) Applicant: Eaton Corporation, Cleveland, OH (US)

(72) Inventors: Josiah Daniel Smith, Mission Viejo, CA (US); Joseph B. Skorjanec, Sioux Falls, SD (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/596,769

(22) Filed: May 16, 2017

(65) Prior Publication Data

US 2017/0331237 A1 Nov. 16, 2017

Related U.S. Application Data

(60) Provisional application No. 62/336,942, filed on May 16, 2016.

(51) Int. Cl.
*H01R 25/00* (2006.01)
*H01R 13/74* (2006.01)

(52) U.S. Cl.
CPC ..... *H01R 25/006* (2013.01); *H01R 13/74* (2013.01)

(58) Field of Classification Search
CPC ..... H01R 13/73; H01R 4/64; H01R 9/2608; H01R 24/006
USPC ..... 439/574, 575, 532
See application file for complete search history.

(56) References Cited

U.S. PATENT DOCUMENTS

| | | | | |
|---|---|---|---|---|
| 4,952,164 | A * | 8/1990 | Weber | H01R 25/006 439/215 |
| 5,094,622 | A * | 3/1992 | Auclair | H01R 4/64 439/92 |
| 6,146,159 | A * | 11/2000 | Brunker | H01R 13/447 174/66 |
| 6,186,825 | B1 * | 2/2001 | Bogiel | H02G 3/128 439/215 |
| 7,645,289 | B2 * | 1/2010 | Bayer | A61B 17/00008 606/159 |
| 7,674,129 | B1 * | 3/2010 | Liu | H02B 1/052 361/807 |
| 8,066,535 | B2 * | 11/2011 | Hsiao | H05K 7/1492 439/719 |
| 2008/0108248 | A1 * | 5/2008 | Lim | H02B 1/052 439/532 |
| 2009/0286422 | A1 * | 11/2009 | Henkel | H02B 1/052 439/532 |
| 2012/0295475 | A1 * | 11/2012 | Fasce | H04Q 1/06 439/532 |
| 2014/0199864 | A1 * | 7/2014 | Devanand | H01R 9/2608 439/116 |
| 2014/0246218 | A1 * | 9/2014 | Shotey | H02G 3/14 174/66 |

(Continued)

*Primary Examiner* — Tulsidas C Patel
*Assistant Examiner* — Marcus E Harcum
(74) *Attorney, Agent, or Firm* — Squire Patton Boggs US LLP

(57) ABSTRACT

The present disclosure is directed to a PDU retention device comprising a rectangular frame having a central cutout portion, a first protrusion extending from the frame into the cutout portion, a guidance fixture permitting the frame to move along a path, and a second protrusion extending from the frame away from the central cutout portion.

20 Claims, 9 Drawing Sheets

(56) References Cited

U.S. PATENT DOCUMENTS

| | | | | |
|---|---|---|---|---|
| 2015/0055356 | A1* | 2/2015 | Derks | H01R 13/24<br>362/418 |
| 2015/0076298 | A1* | 3/2015 | Peter | H02B 1/052<br>248/205.1 |
| 2015/0147908 | A1* | 5/2015 | Jauch | H01R 13/6215<br>439/574 |
| 2017/0170579 | A1* | 6/2017 | Martin | H01R 4/26 |

* cited by examiner

POWER DISTRIBUTION UNIT RETENTION DEVICE

This application claims benefit of the filing date of U.S. provisional application No. 62/336,942, filed May 16, 2016.

FIELD OF INVENTION

This disclosure relates to devices that retain Power Distribution Units on equipment racks. More specifically, this disclosure relates to devices having means to lock Power Distribution Units onto equipment racks to prevent the Power Distribution Units from moving.

BACKGROUND

Equipment racks are used to contain computers and other electronic equipment. Power may be provided to the electronic equipment through one or more Power Distribution Units (PDUs). In some known embodiments, a protrusion (known as a button) is fixed to the rear or side of the PDU, which is configured to slide into a keyhole slot on a mounting bracket that is attached to a rack. This provides tool-less mounting of PDUs, which is very convenient. However, the downside of this method is that the PDU is not rigidly fixed to the bracket, and can pop out if the PDU is jostled. This becomes an issue if the PDU is pre-installed in the rack (sometimes with other equipment) and shipped as a pre-assembled unit.

Two solutions have been used in the industry to solve this issue. The first is to use cable ties, either to tie the power cord to the bottom of the rack or to strap the PDU itself to the rack frame. This method is subject to manufacturing variations in cable tie placement and tightness and has a poor appearance. The second is to attach an "L"-shaped bracket to the top frame of the rack such that it touches to the top of the PDU and prevents it from coming up out of the keyhole slots. This method requires the use of tools to attach the bracket to the rack, and a given "L"-shaped bracket can accommodate variations in the PDU lengths of only up to around 1.5 to 2 inches.

SUMMARY

In one embodiment, a retention assembly includes a mount configured to receive a retention member of a power distribution unit, and a plate that is mounted to and moveable with respect to the mount. The plate further includes a locking member that engages with the retention member.

The retention assembly of this embodiment may further include an opening in the mount having a wide portion and a narrow portion for receiving the retention member. The retention assembly may further include a pin sized and shaped to engage holes in the mount and the plate. Additionally, the plate may include a central opening and two locking members, wherein one of the locking members extends across the central opening of the plate. The mount may alternatively be a frame member of a rack, or a bracket attached to a frame member of a rack. The bracket can be removably connected to the frame member of the rack via a tool-less connection. Finally, the plate may include one slot and the mount may include one boss corresponding to the slot, so that the slot is slideable around the boss.

In another embodiment, a unit for locking a PDU to a frame member of a rack includes a rectangular frame having a cutout in a middle of the frame, a first protrusion extending from the rectangular frame into the cutout portion, a guidance fixture permitting the unit to move along a path, and a second protrusion extending from the rectangular frame away from the cutout portion.

The first protrusion in this embodiment may include a pair of first protrusions and wherein the second protrusion includes a pair of second protrusions. The guidance fixture may be a slot, sized and shaped to receive a boss, or may alternatively be a protrusion adapted to fit within a slot. The unit may be integral with a bracket adapted to receive a power distribution unit, wherein the unit is moveable with respect to the bracket. Finally, the generally rectangular frame of the unit may further include a hole configured to align with a corresponding hole in a bracket, and further configured to receive a pin to fix the unit to the bracket.

In yet another embodiment, a locking assembly includes a bracket having a slot configured to receive a retention member of a PDU, a locking piece that includes a tab sized and shaped for insertion into the bracket slot, and wherein the locking piece includes a release mechanism allowing the locking piece to be selectively secured to the bracket.

The release mechanism in this embodiment may include a first hole on the locking piece that aligns with a second hole in the PDU, and may further include a pin sized and shaped to fit into the first and second holes. The pin may be a snap rivet. The slot of the bracket may be configured to align with the second hole when the assembly is installed. The assembly may further include a PDU having a retention member aligned with a second hole in the PDU. Finally, the release mechanism of this embodiment may be a fastener.

BRIEF DESCRIPTION OF THE DRAWINGS

In the accompanying drawings, structures are illustrated that, together with the detailed description provided below, describe exemplary embodiments of the claimed invention. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figure 1:
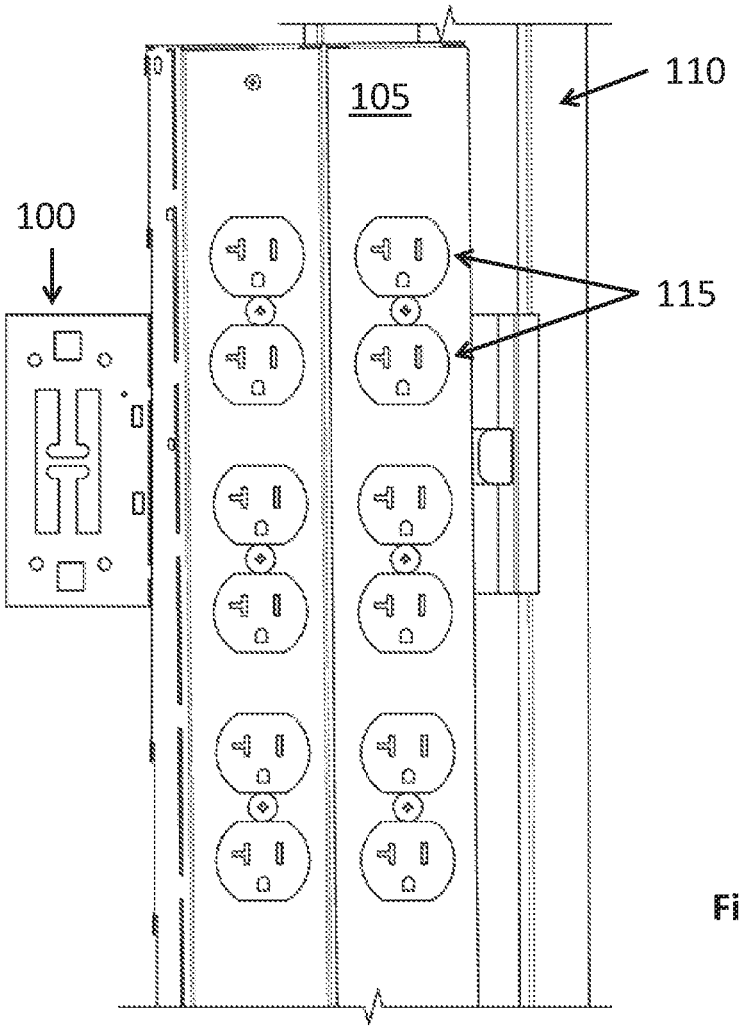
FIG. 1 is a front view of one embodiment of a rack having a mount that retains a PDU.

FIG. 1 is a front perspective view of a mount 100 (also referred to as a bracket) having a PDU 105 attached thereto. The mount 100 and PDU 105 are attached to a frame 110 of a rack for receiving electronic equipment. Frame 110 can include any number of members and can take any form, but is generally rectangular in shape. As typically used in data centers, the frame 110 can receive and contain various types of electronic equipment, such as servers, computers, storage units, hard drives, and any other equipment requiring electricity. The frame 110 may also be used to contain other types of electronic equipment, such as audio or video components.

PDU 105 is affixed to frame 110 via installed mount 100, and includes one or more outlets 115. Although not shown, PDU 105 is connected to a power source through a separate cord, and distributes the power to electronic equipment via outlets 115.

In this embodiment, mount 100 is "tool-less," meaning that it can be installed and uninstalled on frame 110 by hand, without the use of tools. The specific attachment means are described in further detail below. In alternative embodiments (not shown), mount 100 can be a non "tool-less" type, such as one that requires screws or other types of fasteners to engage with frame 110. In other alternative embodiments (not shown), the mount can be made integral with the frame.

Figure 2A:
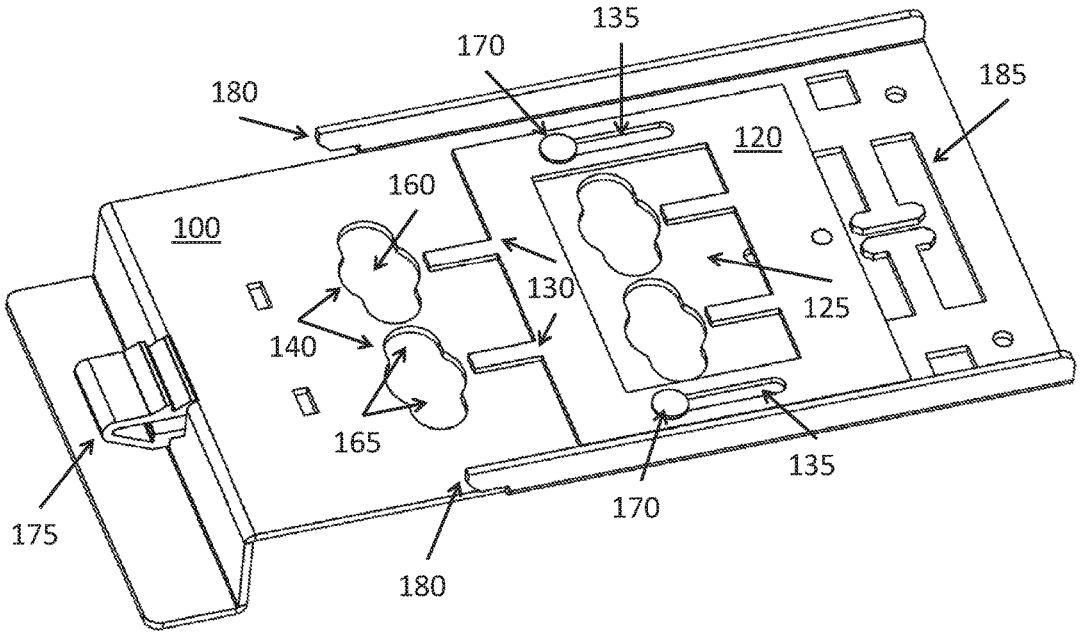
FIG. 2A is a rear perspective view of the mount of FIG. 1.

FIG. 2A illustrates a rear perspective view of the mount 100. Plate 120 in this embodiment is attached to mount 100, and includes a central cutout portion 125 and locking members 130. Plate 120 further includes two parallel slots 135 located on a top portion and a bottom portion of the plate 120. In this embodiment, four locking members 130 are shown, two of which extend only partially across the central cutout portion 125, and two of which extend at a periphery of plate 120. In this embodiment, locking members 130 are rectangular in shape, are generally parallel to each other, and are coplanar with the plate 120.

In alternative embodiments (not shown), plate can take a shape other than the one depicted in FIG. 2A, such as a triangular, polygonal, or circular shape. In other alternative embodiments (not shown), plate may include any number of locking members, and the locking members may take any shape and have any orientation with respect to one another. In other alternative embodiments (not shown), plate may include any number of slots, and the slots may take any shape and have any orientation with respect to one another. In other alternative embodiments (not shown) slots may be replaced with any guidance fixture, for example an elongated groove or a flange.

Figure 3:
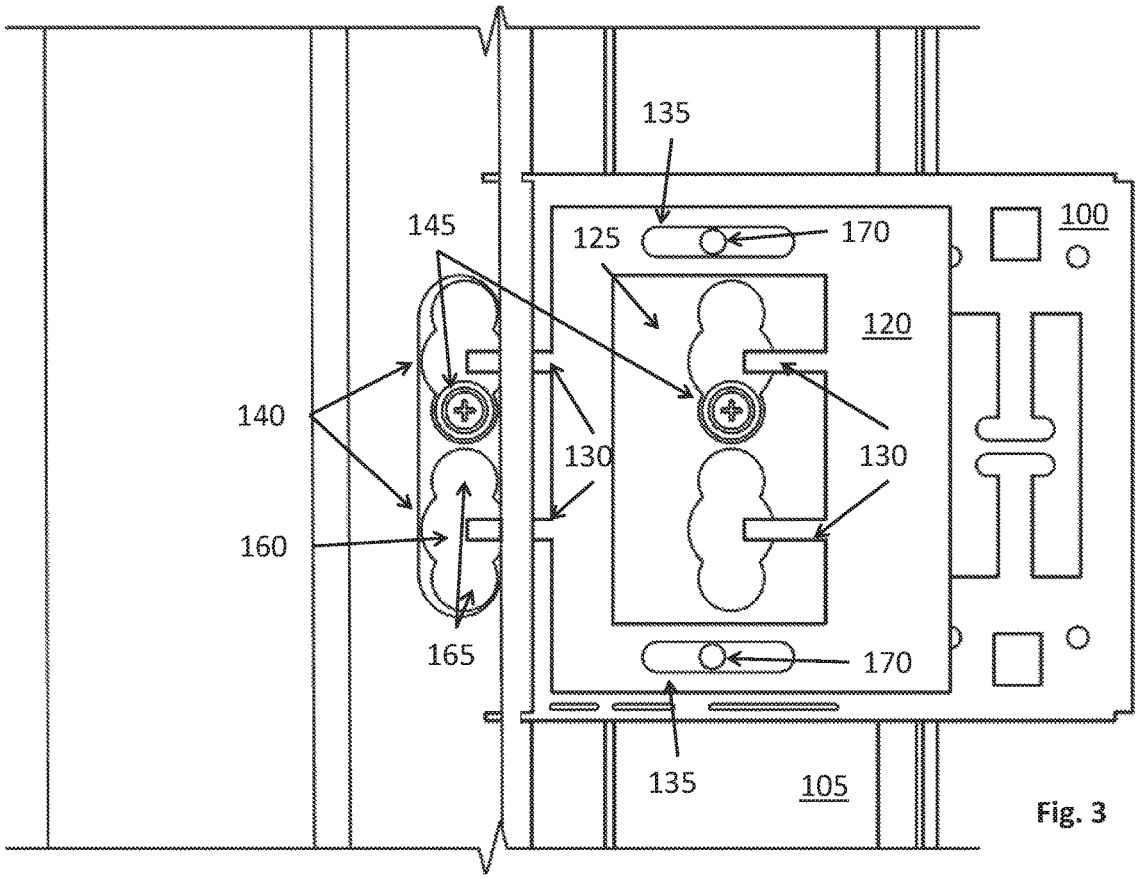
FIG. 3 is a rear view of the embodiment shown in FIG. 1.

With continued reference to FIG. 2A, mount 100 includes one or more keyholes 140 shaped to receive protrusions 145 of PDU 105 (illustrated in FIG. 3). Mount 100 in this embodiment has four keyholes 140, each keyhole 140 having a wider portion 160 and two narrower portions 165.

In alternative embodiments (not shown), keyholes may take different shapes, and the plate may include more or less than four keyholes. In one known embodiment, the keyholes include one wider portion and one narrower portion. In these alternative embodiments, the only requirement of keyholes is that they be shaped to retain elongated protrusions so that the protrusions cannot slide out of keyholes when installed.

Mount 100 further includes guides 170 that are sized and shaped to fit within slots 135 of plate 120. In this embodiment, two guides 170 are shown, and are circular in shape. In alternative embodiments (not shown), the guides and slots can be switched, so that the mount includes slots and the plate includes the guides. Mount 100 further includes a biased latch 175, and hooks 180 for securing the mount 100 to frame 110. Frame 110 includes a slot (not shown) corresponding to latch 175. The slot is dimensioned such that when latch 175 is inserted into the slot, latch 175 snaps against the sides of the slot to prevent removal of the latch 175. Hooks 180 are sized and shaped to fit into corresponding holes (not shown) in frame 110, to fix mount 100 with respect to frame 110.

Mount 100 further includes cable features 185, which are sized and shaped to receive cables of equipment mounted in frame 110. In alternative embodiments (not shown), cable features can be sized and shaped differently, or can be omitted.

Figure 2B:
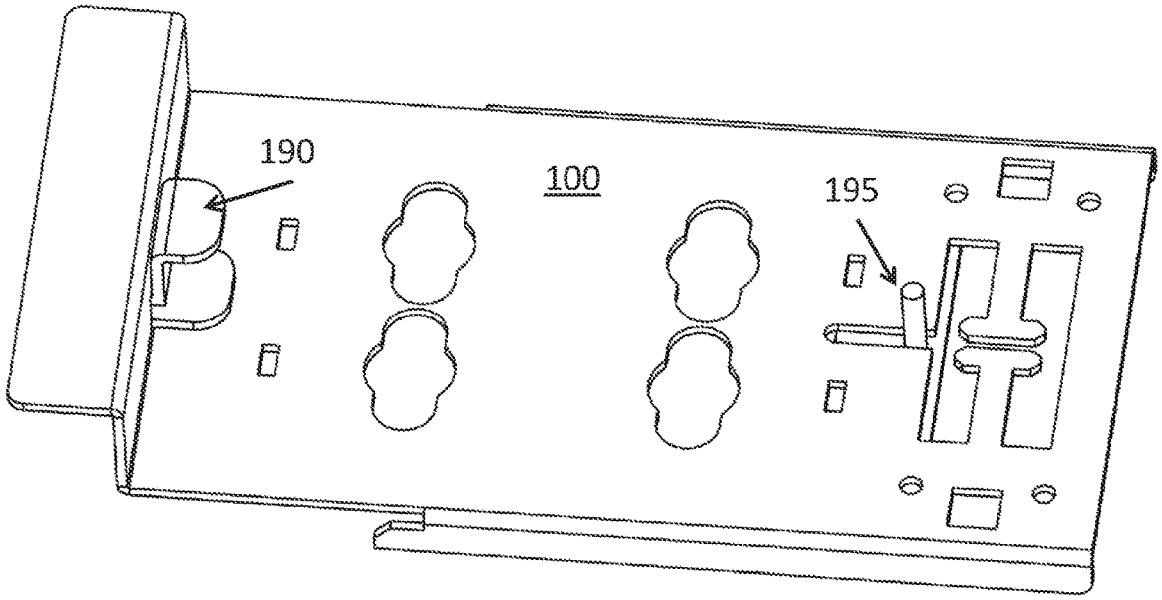
FIG. 2B is a front perspective view of the mount of FIG. 1.

FIG. 2B illustrates a front perspective view of mount 100. As seen in FIG. 2B, mount 100 further includes a latch button 190 that is used to compress latch 175 to allow a user to remove the mount 100 from frame 110. When pressed, latch button 190 opposes the biasing force of latch 175 and compresses the latch 175 so that it can be inserted or removed from its corresponding slot in frame 110.

FIG. 2B further shows a handle 195 attached to plate 120, extending from the front surface of the mount 100. Handle 195 can be used to slide plate 120 into a locked or unlocked position.

Figure 2C:
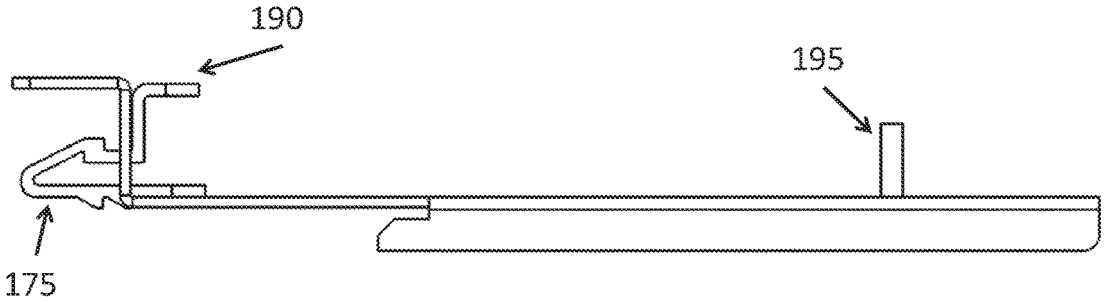
FIG. 2C is a side view of the mount of FIG. 1.

FIG. 2C shows a side view of the mount 100. Side profiles of latch 175 and latch button 190 can be seen in this figure. Handle 195 is shown extending from the front surface of mount 100.

Figure 4:
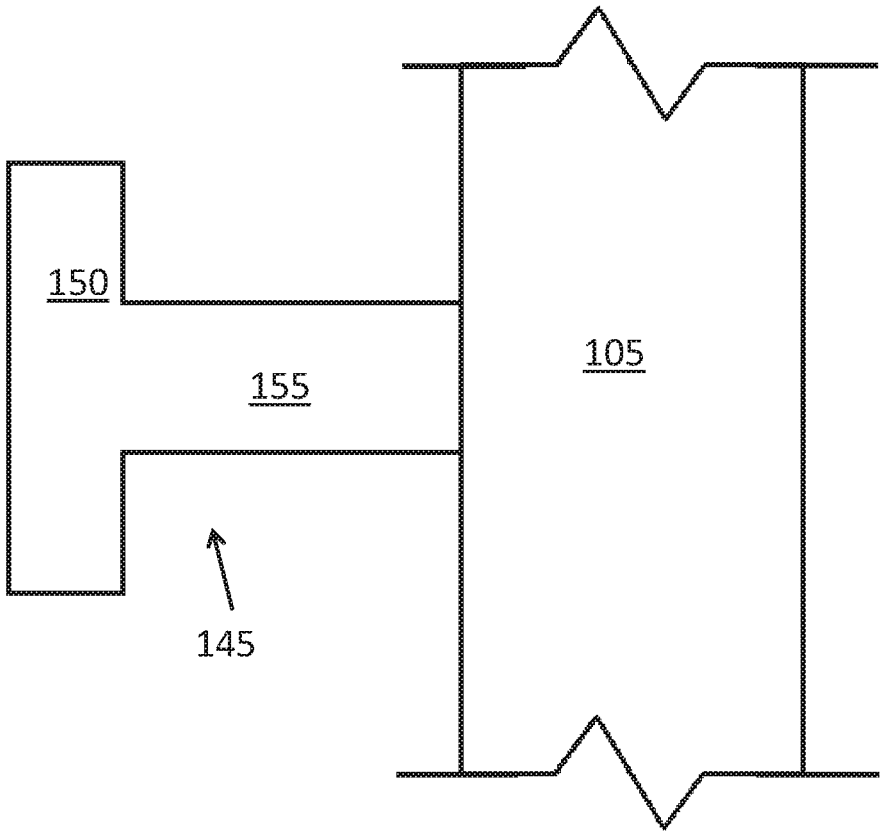
FIG. 4 is a side view of a PDU protrusion used in the embodiments shown in FIG. 1.

FIG. 3 is a rear view of the mount 100, showing details of plate 120. As seen in FIG. 3, wider portions 160 of the keyhole 140 are sized to receive a flat head 150 of the protrusions 145. Flat heads 150 are better seen in FIG. 4, which depicts a protrusion 145 from a side perspective. FIG. 4 further illustrates elongated shafts 155 of the protrusions 145, which are connected at one end to the PDU 105 and at the other end to the flat head 150.

Returning to FIG. 3, narrower portions 165 of the keyhole 140 are sized to be smaller than the flat heads 150 of protrusions 145, so that the flat heads 150 cannot pass through narrower portions 165. Narrower portions 165 are also sized to receive the elongated shaft 155 of each protrusion 145.

An operation of the mount 100 shown in FIG. 3 will now be described. The mount 100 is fixed to frame 110 via fasteners or a tool-less connection such as the one discussed above. The protrusions 145 of PDU 105 are inserted into the wider portions 160 of keyholes 140, and then moved to narrower portions 165 of keyholes 140 after the flat heads 150 of the protrusions 145 have passed completely through keyholes 140. At this stage, the protrusions 145 cannot slide laterally out of the keyholes 140, but can still move up or down within keyholes 140.

Plate 120 is then translated laterally, such that the slots 135 slide along the guides 170. The plate 120 is translated until the locking members 130 are positioned above elongated shafts 155 of protrusions 145. With the plate 120 in this configuration, the protrusions 145 cannot shift upwards and out of keyholes 140. When the plate 120 locks protrusions 145 in place, the PDU 105 is secured to the frame 110 and will not detach from frame 110 when the assembled unit is jostled and bumped during shipping.

In alternative embodiments (not shown), guides 170 could be replaced with removable pegs, allowing plate 120 to be removable.

Figure 5:
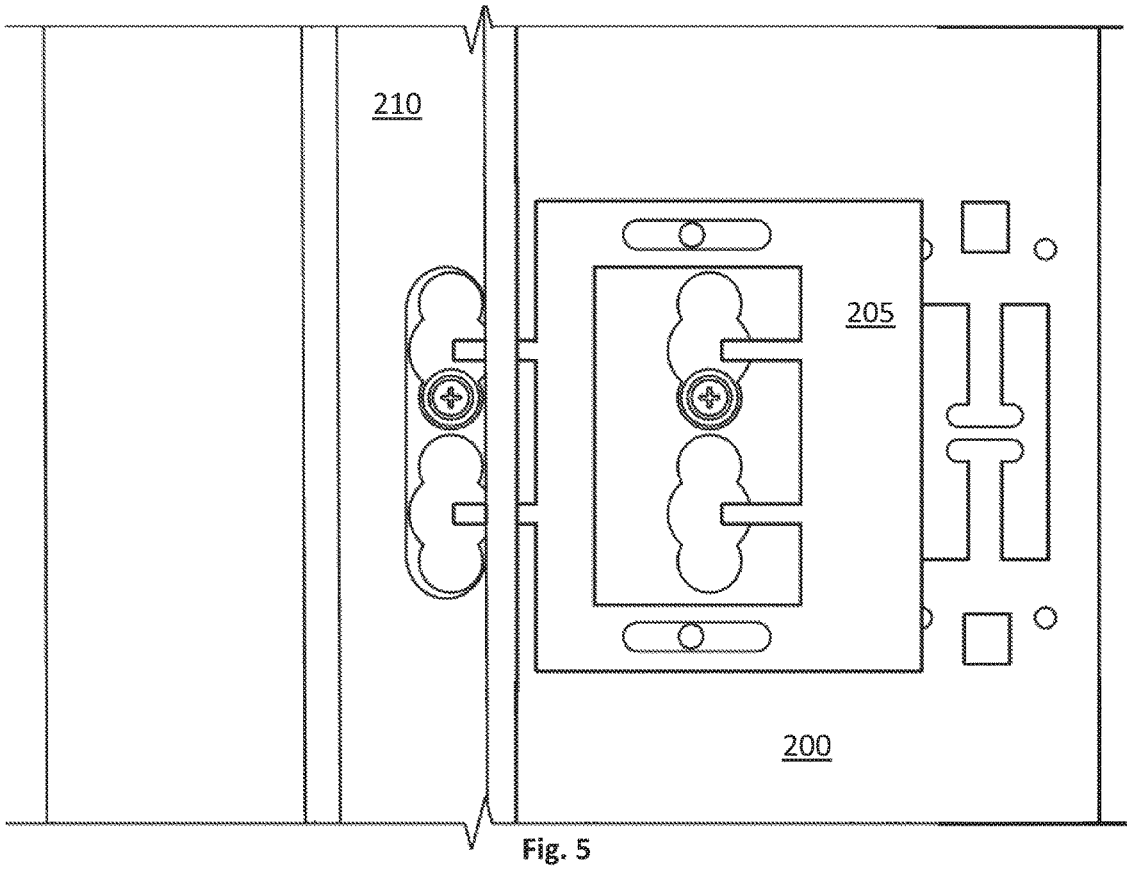
FIG. 5 is a rear view of another embodiment of a rack having an integral mount that retains a PDU.

FIG. 5 depicts an alternative embodiment of mount 200 and plate 205. In this embodiment, the mount 200 is integral with frame 210. Otherwise, the mount 200 and plate 205 function in an identical way to the embodiment of FIG. 3.

Figure 6:
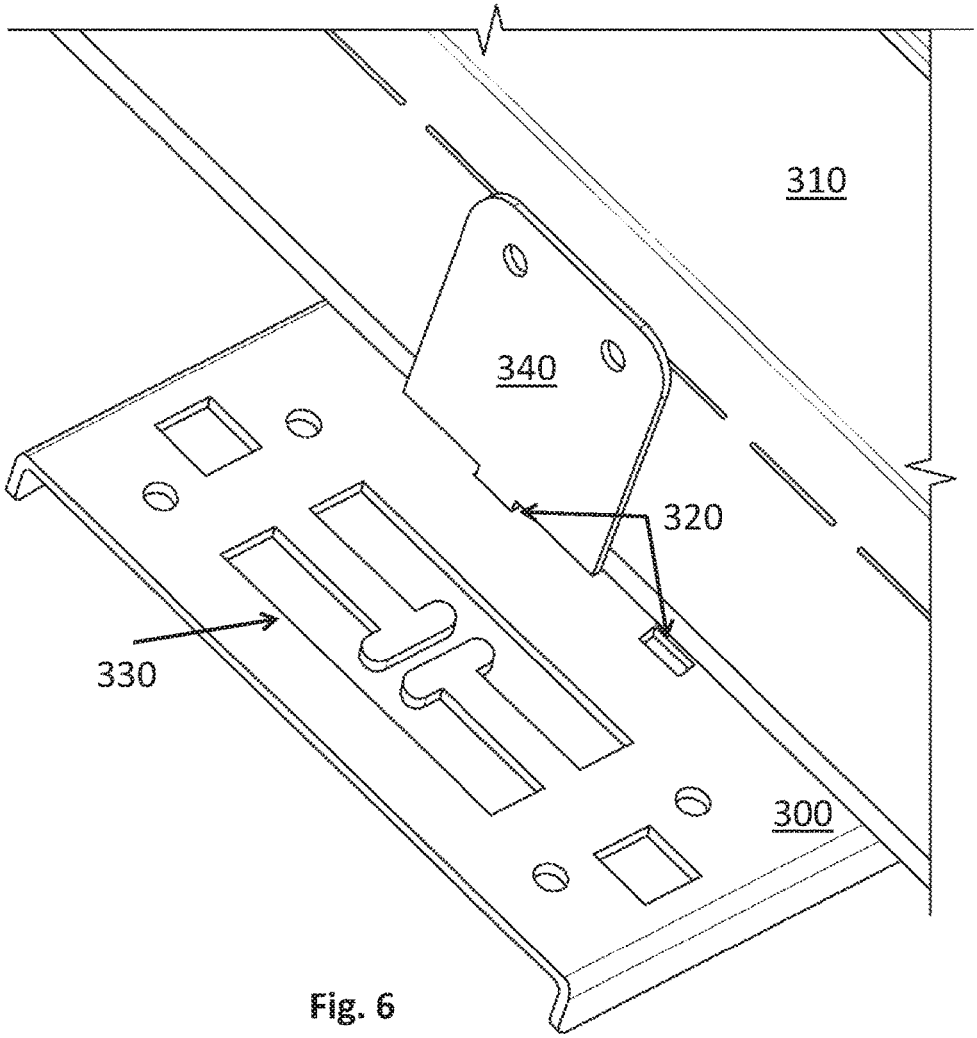
FIG. 6 is an isometric view of another embodiment of a mount, having a locking piece.

FIG. 6 depicts another embodiment of the present disclosure, where a mount 300 is connected to a PDU 310, to affix PDU 310 to the frame of a rack (not shown). Mount 300 includes one or more slots 320 in a surface of the mount 300.

In this embodiment, two elongated slots 320 are provided. Although not shown in FIG. 6, mount 300 includes keyhole structures (or alternatives) identical to the ones described in the embodiments of FIGS. 1-5, to receive protrusions of PDU 310. Mount 300 in this embodiment further includes cable features 330, similar to the cable features discussed in previous embodiments.

In alternative embodiments (not shown), any number of slots may be included on mount, and the slots may take any shape, for example a circular or oblong shape. In other alternative embodiments (not shown), the slots may extend only partially into mount rather than all the way through. In other alternative embodiments (not shown), cable features may be shaped differently or omitted.

Figure 7:
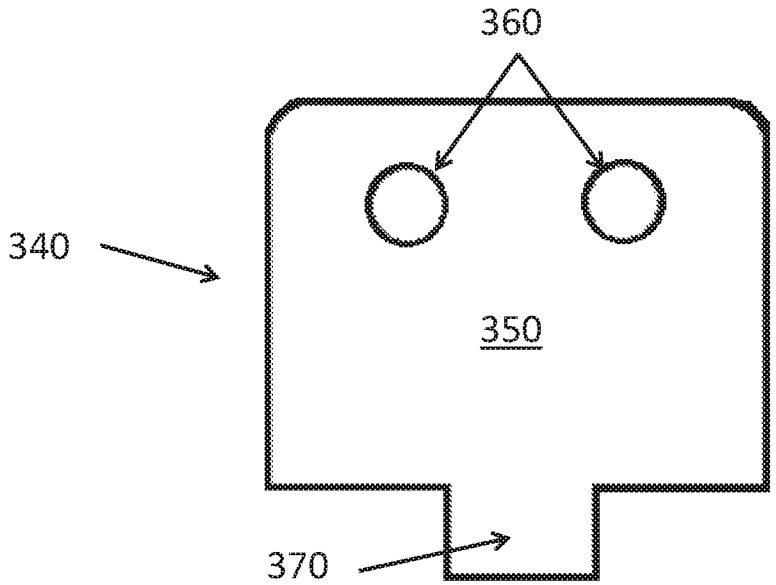
FIG. 7 is a front view of the locking piece from the embodiment shown in FIG. 6.

A locking piece 340 is installed into mount 300, as shown in FIG. 6, and in more detail in FIG. 7. Locking piece 340 includes a flat, generally square body 350, two through holes 360 that extend through the flat, generally square body 350, and a tab 370 extending from a lower portion of the flat, generally square body 340, such that the tab 370 is coplanar with the generally square body 350.

To install the locking piece 340 into the mount 300, the tab 370 is inserted into one of the slots 320. PDU 310 also includes two holes (not shown) that align with through holes 360 of locking piece 340 when PDU 310 is secured to mount 300. One or more pin(s) or snap rivet(s) (not shown) is then inserted into either or both sets of aligned PDU and locking piece holes, to secure locking piece 340 against PDU 310. In this configuration, PDU 310 is prevented from shifting relative to mount 300. One practical advantage of securing PDU 310 in this manner is to prevent it from falling out of engagement with mount 300 when bumped or jostled during shipping.

In alternative embodiments (not shown), locking piece and PDU holes can be replaced with other structures that fix the locking piece 340 to PDU 310, for example, slots and tabs, flanges and grooves, or snap connections. In other alternative embodiments (not shown), pins or snap rivets can be replaced with screws or bolts, and PDU holes can be threaded holes. In other alternative embodiments (not shown), locking piece can have a body of any other shape, a tab of any shape, and any number of through holes. For example, locking piece can have a circular flat body, a triangular flat body, or a trapezoidal flat body. Additionally, the tab could have any shape, such as a rounded shape, pointed, or hooked. Any number of tabs and slots may be included in alternative embodiments of locking piece and mount, respectively. For example, two or three tabs that correspond with the same number of slots may be included. In other alternative embodiments (not shown), the locking piece can include any number of through holes, for example, one, three, four, or zero holes, that correspond with the same number of holes in PDU.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present disclosure has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the disclosure, in its broader aspects, is not limited to the specific details, the representative apparatus and method, and illustrative examples shown and described. Accordingly, departures may be made from such details without departing from the spirit or scope of the applicant's general inventive concept.

What is claimed is:

1. A retention assembly, comprising:

a mount configured to receive a retention member of a power distribution unit;

a plate attached to the mount, wherein the plate includes a central opening, wherein the plate includes a locking member only partially extending across the central opening of the plate, the locking member being coplanar with the plate and configured to prevent movement between the mount and the retention member of the power distribution unit, and wherein the plate is moveable with respect to the mount, such that the locking member can be engaged and disengaged from the retention member.

2. The assembly of claim 1, wherein the mount further includes an opening having a wide portion and a narrow portion for receiving the retention member.

3. The assembly of claim 1, further comprising a pin.

4. The assembly of claim 1, wherein the plate further includes two locking members.

5. The assembly of claim 1, wherein the mount is a frame member of a rack.

6. The assembly of claim 1, wherein the mount is a bracket attached to a frame member of a rack.

7. The assembly of claim 6, wherein the bracket is removably connected to a frame member of a rack via a tool-less connection.

8. The assembly of claim 1, wherein the plate includes at least one slot, and wherein the mount includes at least one boss corresponding to the at least one slot, such that the at least one slot is slideable around the at least one boss.

9. A retainer for locking a power distribution unit to a frame member of a rack, the retainer comprising:

a generally rectangular frame, having a cutout portion in a middle of the frame;

a first pair of protrusions, each of the first pair of protrusions extending from the rectangular frame into the cutout portion;

a guidance fixture, permitting the unit to move along a path; and a second pair of protrusions extending from the rectangular frame away from the cutout portion.

10. The retainer of claim 9, wherein the guidance fixture is a slot, sized and shaped to receive a protrusion.

11. The retainer of claim 9, wherein the guidance fixture is a protrusion adapted to fit within a slot.

12. The retainer of claim 9, wherein the retainer is integral with a bracket adapted to receive the power distribution unit, and wherein the retainer is moveable with respect to the bracket.

13. The retainer of claim 9, wherein the generally rectangular frame of the retainer further includes a hole configured to align with a corresponding hole in a bracket, and further configured to receive a member to fix the retainer to the bracket.

14. A locking assembly, comprising:

a bracket configured to receive a retention member of a power distribution unit, wherein the bracket includes a slot in a surface of the bracket;

a flat locking piece that includes a tab that is coplanar with a main body, wherein the tab is sized and shaped for insertion into the slot of the bracket such that the main body extends substantially perpendicular from the bracket, and wherein the main body of the locking piece is configured to be selectively secured to the power distribution unit.

15. The locking assembly of claim 14, wherein the main body of the locking piece includes a first hole, positioned to align with a hole in the power distribution unit when installed.

16. The locking assembly of claim 15, wherein the main body of the locking piece includes a second hole.

17. The locking assembly of claim 14, further including a fastener for selectively securing the locking piece to the power distribution unit.

18. The locking assembly of claim 14, wherein the main body of the locking piece is generally square shaped.

19. The assembly of claim 1, wherein the mount includes a biased latch and hooks configured to secure the mount to a frame.

20. The retainer of claim 9, wherein the retainer is a flat plate.

* * * * *